US005285934A

United States Patent [19]

Yamauchi et al.

[11] Patent Number: 5,285,934

[45] Date of Patent: Feb. 15, 1994

[54] AUTOMATIC MOLTEN METAL SUPPLYING DEVICE

[75] Inventors: Noriyoshi Yamauchi; Hitoshi Ishida, both of Fuchu, Japan

[73] Assignee: Ryobi, Ltd., Fuchu, Japan

[21] Appl. No.: 944,649

[22] Filed: Sep. 14, 1992

Related U.S. Application Data

[63] Continuation-in-part of Ser. No. 819,744, Jan. 13, 1992, abandoned.

[30] Foreign Application Priority Data

Jan. 14, 1991 [JP] Japan ..... 3-16007

[51] Int. Cl.[5] ..... B22D 39/06

[52] U.S. Cl. ..... 222/595; 266/239

[58] Field of Search ..... 266/209, 239; 222/591, 222/595, 596

[56] References Cited

U.S. PATENT DOCUMENTS

| | | | |
|---|---|---|---|
| 3,050,794 | 8/1962 | Holz | 266/239 |
| 3,128,912 | 4/1964 | Cash | 222/596 |
| 3,191,247 | 6/1965 | Holz | 266/239 |
| 3,499,580 | 3/1970 | Smith | 222/595 |

FOREIGN PATENT DOCUMENTS

| | | |
|---|---|---|
| 0087747 | 8/1930 | Japan . |
| 51-35529 | 10/1976 | Japan . |
| 5555256 | 12/1990 | Japan . |

*Primary Examiner*—Scott Kastler

*Attorney, Agent, or Firm*—Sughrue, Mion, Zinn, Macpeak & Seas

[57] ABSTRACT

An automatic molten metal supplying device capable of supplying the molten metal within a short period of time while maintaining accuracy in a supply amount and preventing dripping of the molten metal from a ladle and temperature decrease of the molten metal during its transferring state even if the transferred molten metal is of a small volume. A molten metal intake/discharge port is formed at a bottom portion of a ladle, and an atmosphere communication/blockage unit is provided which selectively communicates an internal space of the ladle with an atmosphere. After the molten metal is introduced into the ladle through the intake/discharge port, the space is shut off from the atmosphere. A cross-sectional area of the intake/discharge port is in a range of from 28 to 80 mm$^2$. The lower limit of the cross-sectional area of the intake/discharge port is sufficient to allow the molten metal to be flowed into the ladle, and the upper limit thereof is sufficient to prevent the molten metal in the ladle from dripping therefrom. Thus, a small amount of the molten metal can be rapidly and accurately casted.

9 Claims, 6 Drawing Sheets

AUTOMATIC MOLTEN METAL SUPPLYING DEVICE

BACKGROUND OF THE INVENTION

This application is a continuation-in-part of application Ser. No. 07/819,744 filed Jan. 13, 1992, now abandoned.

The present invention relates to an automatic molten metal supplying device, and more particularly, to an automatic supplying device for successively supplying a molten metal such as aluminum and magnesium to a small capacity metal mold.

For automatically supplying a molten metal having a small mass such as from 5 grams to several hundreds grams to a casting port of a die-casting machine, it is generally difficult to maintain accuracy of the supply amount and to prevent the molten metal from cooling. In order to overcome these problems, several proposals have been made. For example, Japanese Patent No. 87747 discloses a piston/cylinder arrangement in which a piston is slidably disposed in a cylinder whose one end is formed with a molten metal intake/discharge port. The piston is slidingly moved in one direction while the cylinder is dipped in the molten metal accumulated in a melting pot, and negative pressure is generated within the cylinder to allow the molten metal to flow into the cylinder through the molten metal intake/discharge port. If the piston is slidingly moved in the opposite direction, the molten metal retained in the cylinder is discharged into a metal mold through the molten metal intake/discharge port.

Further, Japanese Patent Publication No. Sho 51-35529 discloses a device having support tube movable in the vertical direction and rotatable about its axis and a plurality of casting tubes radially extending from the support tube. An air intake passage and air chamber are formed in the support tube, and the air chamber is communicated with the casting tubes through arm tubes. By introducing negative pressure within the air intake passage, negative pressure is applied to the arm tubes through the air chamber so as to suck the molten metal accumulated in a pot into the casting tubes. While maintaining this state, the support tube is rotated to bring the casting tube into a predetermined position corresponding with a casting port of a metal mold.

Furthermore, Japanese Utility Model Application Kokai No. 55-55256 discloses a ladle for transferring a molten metal. An upper open end of the ladle is covered with a lid formed with a hole, and a center portion of a bottom portion of the ladle is formed with a molten metal intake/discharge port. A tube is provided having one end connected to the hole, and another end connected to the opening/closing valve so as to selectively communicate an internal space of the ladle with an atmosphere. If the opening/closing valve is opened, the molten metal is flowed into the ladle, and if the opening/closing valve is closed, the molten metal in the ladle can be transferred. If the valve is again opened, the molten metal in the ladle is discharged into a metal mold. Further, a vacuum suction device is connected to the opening/closing valve for providing negative pressure within the ladle so as to enhance suction efficiency of the molten metal thereinto and to prevent the molten metal from being dripped from the ladle during its transfer.

The above described conventional molten metal supplying device has the following disadvantages: First, in the Japanese Patent 87747 reference, since the cylinder/piston mechanism is provided, the molten metal may be entered into the sliding portion. If such molten metal is solidified, subsequent molten metal supplying cannot be achieved. Particularly, this tendency may be increased, if a small volume of the molten metal is intended to be supplied, since the heat capacity of the molten metal introduced into the cylinder may be lowered, rapid temperature decrease of the molten metal occur. Further, if the molten metal enters into an opposite side of the piston, a piston reciprocating mechanism may also be damaged. Moreover, since the suction of the molten metal is carried out by making use of negative pressure, mobility of the molten metal in the cylinder may become excessive, and therefore, a relatively prolonged period is required for providing a stationary surface of the molten metal. If the cylinder is elevated while the molten metal has an active surface, a desired amount of the molten metal within the cylinder cannot be obtained, which in turn degrades accuracy in the molten metal supply.

According to Japanese Patent Publication No. 51-35529, a plurality of casting tubes must be radially provided around the support tube. Therefore, intricate molten metal passages must be formed within the support tube and the casting tubes. Accordingly, a complicated entire structure is required, which increases production cost of the entire device. Further, since the molten metal is sucked under negative pressure, the molten metal abruptly enters the casting tubes. In such a case, the molten metal may also be entered into passages within the arm tubes in communication with the casting tubes. If the molten metal is adhered and solidified onto the passage a clog may, and subsequent molten metal supplying work cannot be performed. Further, the device has the drawbacks similar to those of the above described patent reference since a vacuum suction system is also utilized performed.

According to the Japanese Utility Model Application Kokai No. 55-55256, significant limitations will result if a device has the vacuum suction device. Further, since the supplying device has a structure in which an interior of the ladle is selectively communicated with the atmosphere, various problems may arise if the size of the intake/discharge port is inappropriate. That is, if a cross-sectional area of the intake/discharge port is too large, the molten metal within the ladle may easily be leaked through the port even though efficiency in introducing the molten metal into the ladle can be enhanced. Accordingly, efficiency in molten metal supplying may be lowered since the molten metal may be dripped onto ambient mechanical components and working areas during transfer of the molten metal. Further, if the intake/discharge port has large cross-sectional area, an oxide film floating on the molten metal in the pot is also introduced into the ladle. Thus, quality of a mold product may be degraded if the oxide film is injected into the metal mold. On the other hand, if the cross-sectional area of the intake/discharge port is too small, the molten metal cannot be smoothly introduced into the ladle even though leakage of the molten metal through the port can be avoided. Further, molten metal discharging speed from the ladle may be lowered, which causes a prolonged shot cycle, and lowers productivity. If the shot cycle is prolonged, temperature of the molten metal within the ladle is promptly decreased if small amount of the molten metal is carried in the ladle. In view of the above, even though the area of the molten metal intake/discharge port is extremely important, the prior art references do not suggest nor disclose the importance, of this fact and consequently, the above described drawbacks exist therein.

SUMMARY OF THE INVENTION

Thus, it is an object of the present invention to provide an automatic molten metal supplying device in which no temperature decrease of the molten metal occurs during its transfer irrespective the volume of the molten metal, and molten metal can be supplied without lowering accuracy in supplying amount, and a reduction in shot cycle can be provided without affecting operation of the supplying device.

In order to achieve the above described objects, the present invention is an automatic molten metal supplying device including a ladle formed with a molten metal intake/discharge port having an improved cross-sectional area, a lid portion, a tubular member, and atmosphere communication/blockage means. The ladle has an upper opening portion, a bottom portion formed with a molten metal intake/discharge port, and an inner surface defining a molten metal accumulating space. The lid portion is adapted for closing the upper open end of the ladle and formed with a through hole. The tubular member has one end connected to the through hole and another end. The atmosphere communication/blockage means is connected to the other end of the tubular member for selectively disconnecting the molten metal accumulating space from the atmosphere in order to retain the molten metal in the accumulation space. A confined space is provided within the ladle and the tubular member when the molten metal is retained in the accumulation space. The cross-sectional area of the molten metal intake/discharge port is in a range of from 28 to 80 $mm^2$ capable of successively supplying small amounts of the molten metal to a desired location.

For introducing the molten metal into the ladle, the molten metal accumulating space of the ladle is communicated with the atmosphere by the atmosphere communication/blockage means, and the ladle is dipped in the molten metal in a pot while maintaining the ladle at a predetermined vertical position. Since the molten metal intake/discharge port has a sufficient area capable of allowing the molten metal to be flowed into the ladle, the molten metal in the pot is smoothly entered into the molten metal accumulating space until the surface level of the molten metal in the accumulating space is equal to the surface level thereof in the pot. If the molten metal of a predetermined amount is entered into the ladle, the atmosphere communication/blockage means is shut off, so that the molten metal accumulation space is out of communication while the atmosphere. With maintaining this state, the ladle is transferred to a casting port of a die casting machine. In this case, the molten metal intake/discharge port has a cross-sectional area capable of providing sufficient surface tension which prevents the molten metal from dripping therethrough. Thus, during transportation, leakage of the molten metal through the port is prevented. Further, during this transferring period, the molten metal in the ladle is slightly moved down because of its own weight metal, and the molten metal is bulged or projected out of the molten metal intake/discharge port. Thus, the volume of air sealed in the molten metal accumulating space is slightly increased, which causes a decrease in air pressure. Accordingly, the molten metal retaining ability of the ladle can further be enhanced. In view of this, the cross-sectional area of the molten metal intake/discharge port is selected in such a manner that sufficient surface tension of the molten metal can be generated at the port so as to overcome the bulging or protruding force of the molten metal through the port. If the molten metal intake/discharge port reaches the casting port of the die casting machine, such as a casting port of an injection sleeve, the atmosphere communication/blockage means is again operated to allow the molten metal accumulating space to be communicated with the atmosphere, so that the molten metal in the ladle can be discharged and poured into the casting port because of the atmospheric pressure and its own weight.

DETAILED DESCRIPTION OF THE PREFERRED EMBODIMENTS

Figure 1:
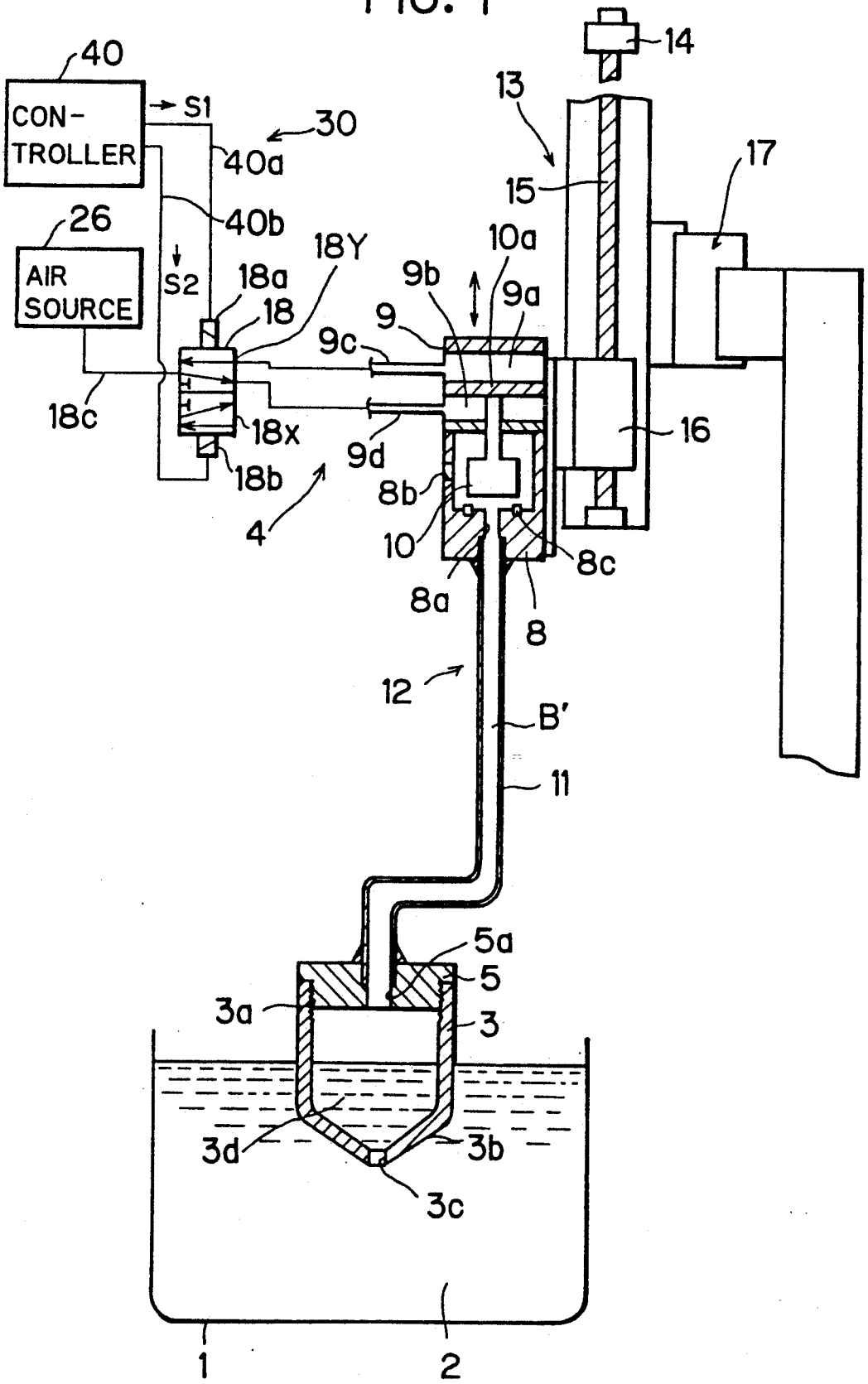
FIG. 1 is a schematic view showing an automatic molten metal supplying device according to a first embodiment of the present invention.

An automatic molten metal supplying device according to a first embodiment of the present invention will be described with reference to FIG. 1. A ladle 3 used in the depicted embodiment is adapted to be movably dipped in a molten metal 2 accumulated in a pot 1. The ladle 3 has an upper open end portion 3*a* and a tapered bottom portion 3*b* whose apex end is formed with a molten metal intake/discharge port 3*c*. A lid portion 5 is engageable with the upper open end 3*a* for closing the open end area, to thereby define a molten metal accumulating space 3*d*. A through hole 5*a* is bored in the lid portion 5. The through hole 5*a* is connected to an atmosphere communication/blockage means 4.

Atmosphere communication/blockage means 4 has a valve body 8, a pneumatic cylinder 9, an opening/closing valve 10 and a cylinder drive mechanism 30. The opening/closing valve 10 is connected to a piston 10*a* slidably disposed in the pneumatic cylinder 9, and the piston 10*a* divides the pneumatic cylinder 9 into first and second cylinder chambers 9*a* and 9*b*. The first and second cylinder chambers 9*a* and 9*b* are connected to one ends of first and second air passages 9*c* and 9*d*, respectively. Another ends of the air passages 9*c* and 9*d* are connected to the cylinder drive mechanism 30. The opening/closing valve 10 is movably provided in the valve body 8. The valve body 8 is provided with a seal member 8c and is formed with a bore 8a at a position in abutment with the opening/closing valve 10. Further, a communication hole 8b is formed at a side wall of the valve body 8. The bore 8a is connected to the through hole 5a of the lid 5 by means of a tube member 11.

The cylinder drive mechanism 30 includes an electromagnetic valve 18 having first and second solenoids 18a and 18b, and an air source 26 connected to the electromagnetic valve 18 by way of an air passage 18c. The first and second solenoids 18a and 18b are connected to a controller 40 of a die casting machine through lines 40a and 40b, respectively so as to change-over the electromagnetic valve 18 to one of first change-over position 18X and a second change-over position 18Y. (FIG. 1 shows the second change-over position). Further, the other ends of the first and second passages 9c and 9d are connected to the electromagnetic valve 18. Thus, compressed air is applied selectively to one of the first and the second cylinder chambers 9a and 9b for moving the piston 10a downwardly or upwardly to thereby open or close the opening/closing valve 10.

The ladle 3 and the atmosphere communication/-blockage means 4 constitute molten metal supplying unit 12 which is supported by a vertical moving means 13. The vertical moving means 13 includes a drive motor 14, a ball screw 15 coupled to the drive motor 14, and a slider 16 threadingly engaged with the ball screw 15. The valve body 8 is attached to the slider 16. Upon rotation of the drive motor 14, the ball screw 15 is rotated about its axis for moving the slider 16 upwardly or downwardly. Accordingly, the dipping amount of the ladle 3 into the pot 1 is controllable. The vertical moving means 13 is connected to a transfer unit 17 for horizontally carrying the ladle 3 to bring the intake/discharge port 3c of the ladle 3 into alignment with a casting port (not shown) of an injection sleeve(not shown) of a metal mold (not shown) in a die-casting machine and to reversely move the ladle 3 toward the pot 1.

Figure 2:
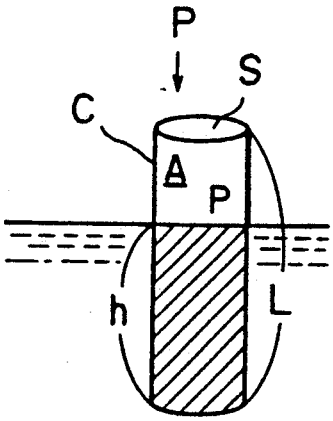
FIG. 2 is a view showing a molten metal introduction state for description of molten metal retaining principle in the ladle.
Figure 3:
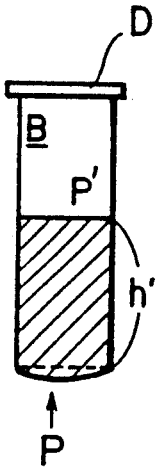
FIG. 3 is a view showing a molten metal retaining state for description of molten metal retaining principle.
Figure 4:
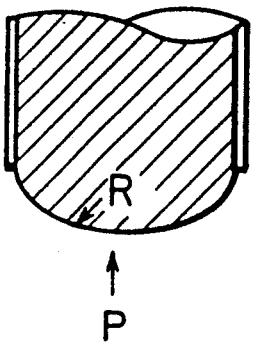
FIG. 4 is a view showing a configuration of the retained molten metal at an intake/discharge port for description of molten metal retaining principle.

The molten metal retaining principle of the ladle 3 will next be described with reference to FIGS. 2 through 4. Assuming that a sleeve member C having both open ends has a cross-sectional area of S and a length L. The sleeve member C is dipped into a liquid having a density $\rho$ to a depth h. In this case, assuming that a sleeve part which is not dipped into the liquid has a volume A, and atmospheric pressure is P. While maintaining this condition, as shown in FIG. 3, the upper open end of the sleeve member C is closed by a lid D, and then the sleeve member C is moved out of the liquid. Provided that the liquid in the sleeve member C is not dripped therefrom, as shown in FIG. 4, the liquid is bulged out of the lower open end yet surface tension of the liquid is still sufficient for preventing the liquid from discharging. Accordingly, the liquid height in the sleeve member C is reduced from h to h' as shown in FIG. 3. Thus, a volume of an inner space defined by the lid D is increased from A to B, and accordingly, the inner pressure is lowered from P to P'. In this instance, when considering a force balance capable of retaining the liquid in the sleeve member C, the equation of $P'+\rho h'=P$ can be provided, since atmospheric pressure P is applied to the lower open end portion of the sleeve C. Incidentally, the pneumatic pressure P' within the confined space of the sleeve C is represented by $P'=(L-h)P/(L-h')$. Since the numerator $(L-h)$ is smaller than denominator $(L-h')$, P' is evidently smaller than P.

The liquid surface at the bottom open end of the sleeve C has a roundish shape as shown in FIG. 4. Because of the surface tension of the liquid, the liquid in the sleeve C can be retained therein. In consideration of pressure difference $\Delta P$ between inner and outer surfaces of the retained liquid, $\Delta P=2T/R$. Here, T represents the surface tension, and R represents radius of curvature of the bulged liquid. If the pressure difference $\Delta P$ is lower than a predetermined level, it becomes impossible the liquid to exhibit a liquid sealing function at the lower open end portion of the sleeve. On the other hand, since the radius of curvature is proportional to a diameter of the sleeve, the radius of curvature R becomes large if the sleeve has large diameter, to thereby lower $\Delta P$ since the surface tension T is a constant value.

In view of the foregoing, the analysis of the diameter of the sleeve is applicable to a determination of a diameter of the intake/discharge port of the ladle 3 shown in FIG. 1. That is, in order to reduce the shot cycle and to enhance a reduction function of the pneumatic pressure in the confined space B, a relatively large diameter of the sleeve must be required. However, in order to maintain the reduction in the pressure difference $\Delta P$ within a predetermined range, the diameter of the sleeve must be relatively small. Thus, it would be understood that the diameter must be determined in view of these conflicting considerations.

In summary, for the aspect of a retainability of the molten metal in the ladle 3, the determination of an upper limit area of the intake/discharge port 3c is important. On the other hand, for the aspect of entering ability of the molten metal into the ladle 3, the determination of a lower limit area of the intake/discharge port 3c is important.

First, the upper limit area is investigated.

Assuming the cross-sectional area of the sleeve member C as being a cross-sectional area of the intake/discharge port 3c of the depicted embodiment, experiments have been conducted in order to investigate the leakage of the molten metal in accordance with variations of the diameter of the intake/discharge port 3c. The molten metal was aluminum (JISADC10), and the temperature of the molten metal was 770°±10° C.

In order to investigate the relationship between the diameter of the intake/discharge port and the leakage of the molten metal, ten sleeve members were prepared having diameters of 5 mm, 6 mm, 7 mm, 8 mm, 9 mm, 10 mm, 11 mm, 12 mm, 13 mm, and 15 mm. Molten metal supplying amounts were 60 plus minus 10 g and 180 plus minus 10 g, and leakage of the molten metal through the sleeve members were measured in each case of the supplying amounts. As a result of the experiments, in case of the employments of the sleeve members having diameters ranging from 5 mm to 10 mm, no molten metal leakage occurred when supplying the molten metal whose amount was 60 plus minus 10 g. On the other hand, in case of the employments of the sleeve members having diameters ranging from 11 to 13 mm, a small amount of the molten metal leaked from the sleeves. If the sleeve having the diameter of 15 mm was used, the molten metal leaked therefrom. The same is true with respect to the supply of the molten metal whose weight is 180 plus minus 10 g.

As is apparent from the above described experiments, allowable upper limit diameter is concluded to be 10 mm which is capable of providing sufficient surface tension so as to avoid the leakage of the molten metal (so as to provide retainability of the molten metal in the ladle 3). Thus, the maximum available cross-sectional area of about 80 $mm^2$ is calculated on the diameter.

Next, molten metal entering ability into the ladle 3 in relation to the area of the intake/discharge port 3c is investigated. As described above, the molten metal can be retained in the ladle 3 if the area of the intake/discharge port 3c is not more than 80 $mm^2$. On the other hand, if the area is too small, the molten metal introducing speed into the ladle 3 is lowered, and molten metal discharging speed from the ladle is also lowered. Therefore, the temperature of the molten metal in the ladle may be lowered, which causes a degradation of the molded product. Further, a prolonged shot cycle may result thus lowering the productivity. Therefore, excessively small cross-sectional area is not practical for the actual production. In this connection, it is necessary to determine the lower limit area of the intake/discharge port 3c in order to shorten the shot cycle.

For testing the molten metal introducing ability into the ladle 3, a plurality of actual ladle samples such as those shown in FIG. 1 having an inner diameter of 30 mm and a depth of 135 mm were prepared. Diameters of the intake/discharge ports were varied in order to investigate the relationship between the diameter of the intake/discharge port and the molten metal introduction ability into the ladles. The relationship is shown in a Table shown below.

Figure 8:
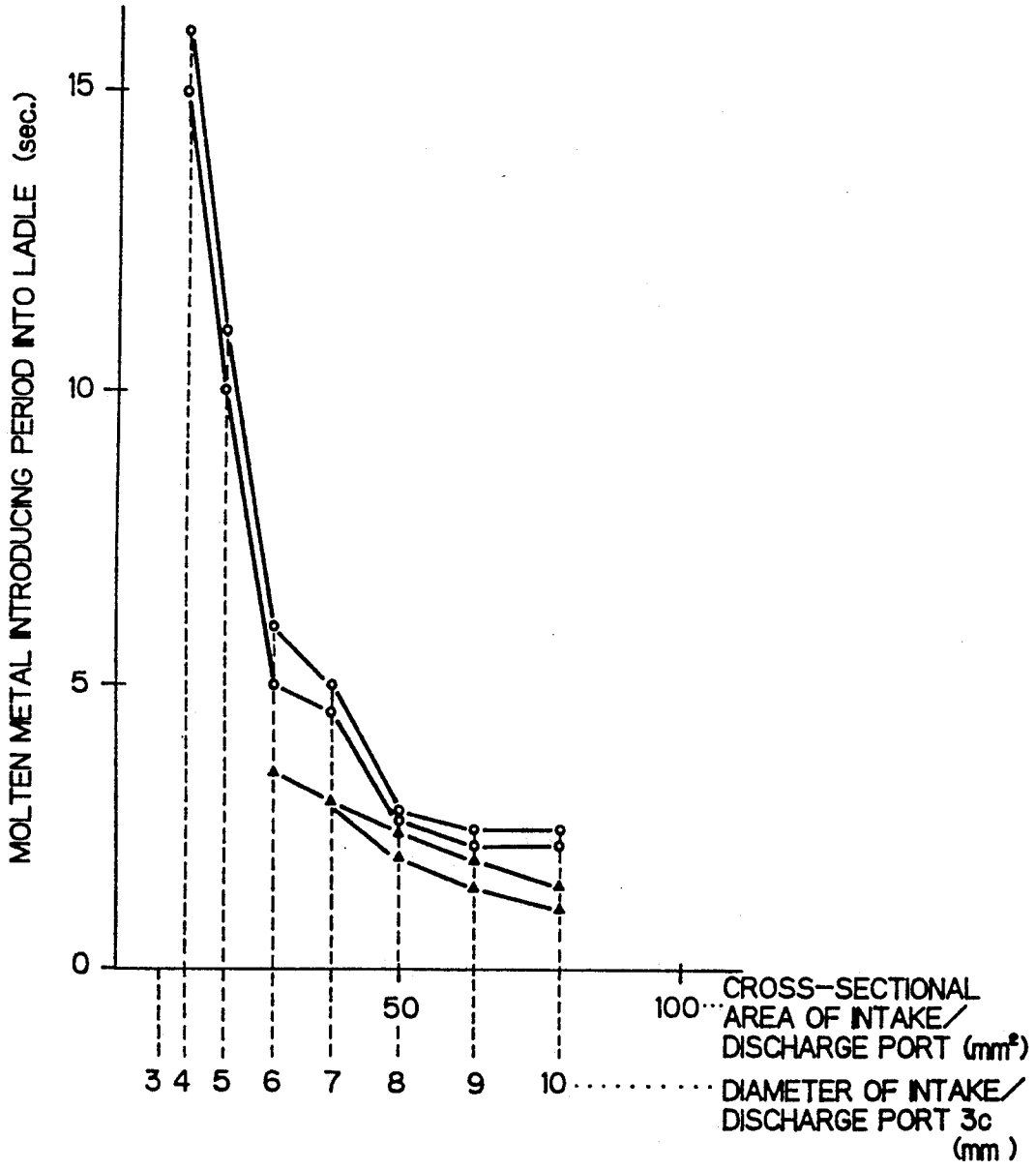
FIG. 8 is a graphical representation showing the relationship between cross-sectional area of an intake/discharge port of a ladle and a period for introducing required amount of molten metal into the ladle.

The molten metal was aluminum (JIS ADC10), and the temperature of the molten metal was 705°±5° C. Required molten metal introduction amount into the ladle was set to 60 g and 180 g, and period for introducing the required amount into the ladle was measured. The testing were conducted twice per each of the ladles. The test data shown in the Table are mean value based on the twice measurements. Further, the relationship between the area of the intake/discharge port and the period for introducing the required amount of the molten metal into the ladle is represented in a graph shown FIG. 8. In the graph, twice measurements are shown with respect to introduction amount of 180 g (circled points) and 60 g (triangular points).

In the above table, the mark "X" indicates non-entry of the molten metal into the ladle. As is apparent from the above Table and the graph shown in FIG. 8, it was impossible to introduce the 60 grams of molten metal into the ladle if the diameter of the intake/discharge port 3c was not more than 6 mm. Further, it took relatively long period such as 15.5 and 10.5 seconds for introducing 180 g of molten metal into the ladles whose intake/discharge ports had diameters of 4 mm and 5 mm. Furthermore, if the intake/discharge port had a diameter of 3 mm, it was impossible to introduce 60 g and 180 g of molten metals into the ladle.

In an automated casting of the molten metal having small amount such as from 5 to several hundreds grams, required shot cycle falls in a range of from 10 to 16 seconds in view of unwanted solidification of the molten metal within the ladle during its transfer to the casting spot. After a required amount of the molten metal is completely introduced into the ladle 3, it takes about 4.6 seconds for moving the ladle from the metal pot 2 to a position above a casting port. 1.4 seconds may be required for actual pouring. Then, 4.4 seconds may be required from the end timing of the casting to the start timing of the molten metal introduction into the ladle. Therefore, totally, 10.4 seconds are required for necessary operation other than molten metal introduction into the ladle. Consequently, the molten metal introducing period must be within 5.6 seconds (16−10.4) in order to fall the shot cycle within 16 seconds.

Thus, the intake/discharge port must provide a diameter not less than 6 mm in order to shorten the molten metal introduction period into the ladle and in order to shorten the shot cycle. Accordingly, the lower limit area of the intake/discharge port 3c is concluded to be about 28 $mm^2$.

Operation of the automatic molten metal supplying device provided with the ladle 3 formed with the intake/discharge port 3c having the cross-sectional area thus described in the above described experiments will now be discussed.

For introducing the molten metal in the pot 1 into the ladle 3, the opening/closing valve 10 is operated to be opened. That is, when the valve opening signal S1 is transmitted from the controller 40 to the solenoid 18a, the electromagnetic valve 18 is changed-over to the second change-over position 18Y, so that compressed air in the air source 26 is applied to the second cylinder chamber 9b through the air passage 18c, the electromagnetic valve 18 and the second air passage 9d. On the other hand, air in the first cylinder chamber 9a is discharged to the atmosphere through the first air passage 9c and the electromagnetic valve 18. Thus, the opening/closing valve 10 is elevated and is moved away from the bore 8a. Accordingly, atmosphere is introduced into the molten metal accumulation space 3d through the communication hole 8b, the tube 11 and the through hole 5a.

While maintaining this state, the drive motor 14 of the vertical moving means 13 is rotated by a predetermined angular amount so as to rotate the ball screw 15 about its axis, to thereby move the slider 16 to a predetermined position. Thus, the lower portion of the ladle 3 is dipped in the molten metal 2 by a predetermined depth. In this case, since the molten metal accumulating space 3d is communicated with the atmosphere through the communication hole 8b, the tube 11 and the through hole 5a of the lid 5, the molten metal 2 in the pot 1 is introduced into the molten metal accumulation space 3d until the level of the molten metal in the space is equal to the molten metal surface level in the pot 1.

When predetermined amount of molten metal has been introduced into the ladle 3, the opening/closing valve 10 is to be closed. That is, when the valve closing signal S2 is transmitted from the controller 40 to the solenoid 18b, the electromagnetic valve 18 is changed-over to the first change-over position 18X. As a result, the compressed air is applied to the first cylinder chamber 9a of the pneumatic cylinder 9 through the air passage 18c, the electromagnetic valve 18 and the first air passage 9c. On the other hand, air in the second cylinder chamber 9b is discharged to the atmosphere through the second air passage 9d and the electromagnetic valve 18. Thus, the opening/closing valve 10 is moved downwardly to close the bore 8a through the seal member 8c. Consequently, the molten metal accumulating space 3d is shut off from the atmosphere. Subsequently, the vertical moving means 13 is operated for elevating the molten metal supplying unit 12. In this case, since the cross-sectional area of the intake/discharge port 3c is properly selected, the molten metal 2 in the ladle 3 is not discharged through the intake/discharge port 3c.

Upon completion of the elevation of the molten metal supplying unit 12, the transfer unit 17 is operated for moving the molten metal supplying unit 12 to the casting port of the injection sleeve (not shown) in the die-casting machine. Then, the molten metal in the ladle 3 is poured into the injection sleeve. In this case, the pneumatic cylinder 9 is again operated to open the opening/-closing valve 10 in order to introduce atmosphere through the communication hole 8b into the molten metal accumulating space 3d by way of the tube 11 and the through-hole 5a. As a result, the molten metal in the ladle 3 is dropped into the injection sleeve through the intake/discharge port 3c because of atmospheric pressure and its own weight metal. Upon completion of the molten metal supply into the injection sleeve, the transfer unit 17 is operated so that the molten metal supplying unit 12 is again moved to a position above the pot 1. The above operation is repeatedly carried out for effectively and successively supplying the molten metal into the injection sleeve.

Figure 5:
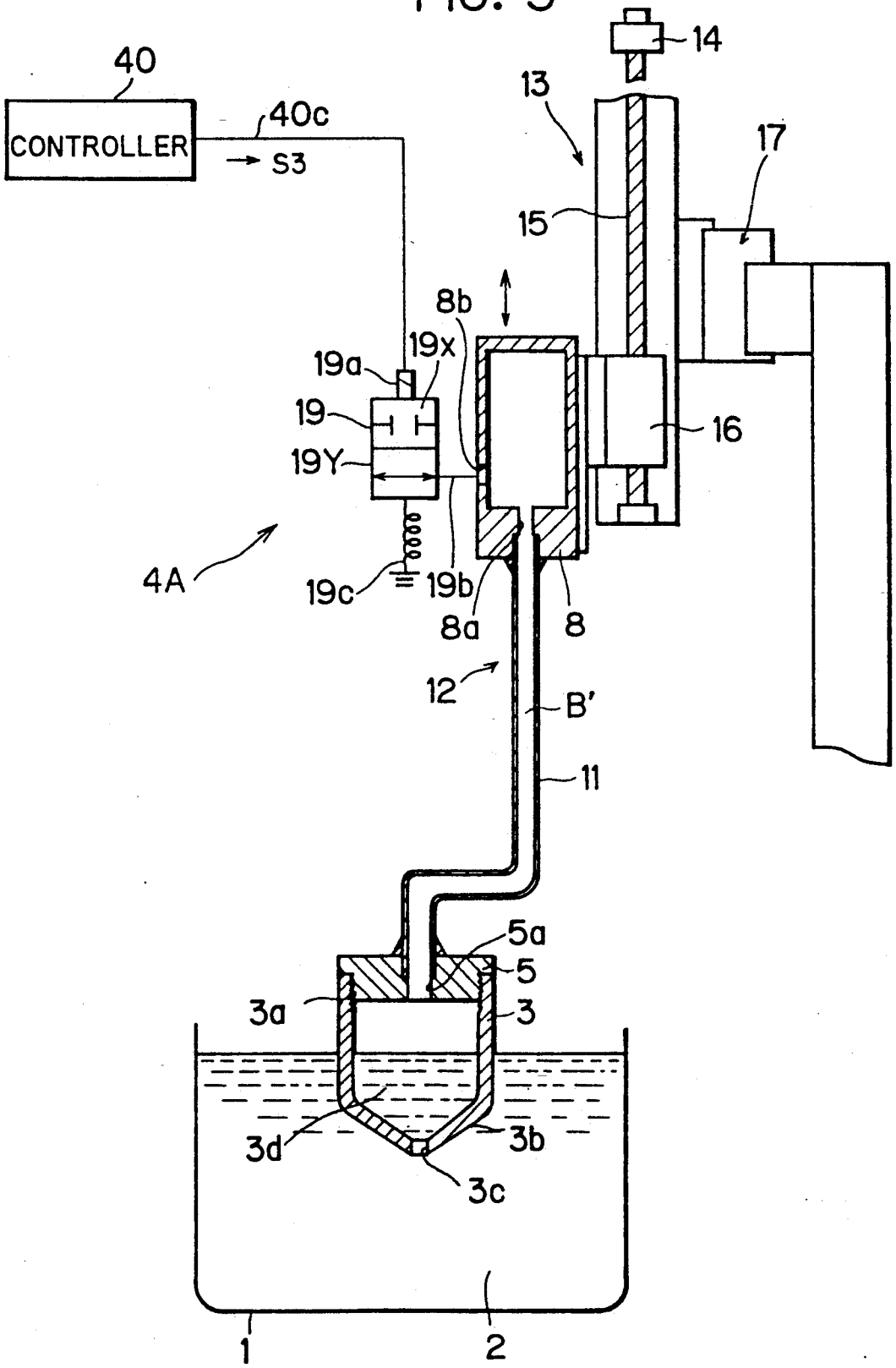
FIG. 5 is a schematic view showing an automatic molten metal supplying device according to a second embodiment of this invention.

Next, an automatic molten metal supplying device according to a second embodiment of this invention will be described with reference to FIG. 5, wherein like parts and components are designated by the same reference numerals as those shown in FIG. 1. The second embodiment is substantially similar to the first embodiment except for atmosphere communication/blockage means 4A.

More specifically, the atmosphere communication/-blockage means 4A of the second embodiment does not include the opening/closing valve 10 and the piston 10a such as those used in the first embodiment. More specifically, an internal space defined by the valve body 8 is selectively communicatable with the atmosphere through an electromagnetic valve 19 and an air passage 19b. The electromagnetic valve 19 is adapted to provide a first change-over position 19X where the interior of the valve body 8 is shut off from the atmosphere, and a second change-over position 19Y where the valve interior is communicated with the atmosphere. (Incidentally, FIG. 5 shows the second change-over position.) To this effect, the electromagnetic valve 19 is provided with a solenoid 19a which is connected to a controller 40 of the die-casting machine through a line 40c. Further, a spring 19c is connected to the electromagnetic valve 19 for normally urging the latter 19 to assume the second change-over position 19Y.

With this arrangement, for introducing the molten metal into the ladle 3, no control signal is transmitted from the controller 40. Therefore, the electromagnetic valve 19 assumes the second change-over position 19Y because of the biasing force of the spring 19c as shown in FIG. 5. Consequently, internal space of the valve body 8 is communicated with the atmosphere for allowing the molten metal 2 to be introduced into the ladle 3. For carrying the molten metal 2 retained in the ladle 3 to the injection sleeve, atmosphere blockage signal S3 is transmitted from the controller 40 to the solenoid 19a through the line 40c, so that the electromagnetic valve 19 is changed-over to the first change-over position 19X against the biasing force of the spring 19c. As a result, the interior of the valve body 8 is shut off from the atmosphere. Accordingly, the molten metal accumulation space 3d in the ladle 3 is also shut off. Thus, the molten metal 2 can be retained in the ladle 3 without any leakage through the intake/discharge port 3c during transportation. Other operations are the same as those of the first embodiment, and therefore, further description is omitted.

An automatic molten metal supplying device according to a third embodiment of this invention will next be described with reference to FIG. 6. The third embodiment is an improvement on the first and the second embodiments in order to further prevent the molten metal retained in the ladle 3 from leaking out of the intake/discharge port 3c during transportation of the ladle. To be more specific, in case of the transfer of the molten metal, air confined in the ladle 3 and the tube 11 may be expanded due to heat of the molten metal 2. Therefore, in FIG. 3, the pressure P' of the confined space B may increase and reach the proximity of the atmospheric pressure P. Due to the inner pressure increase, the molten metal 2 retained in the ladle 3 may be dripped therefrom. In other words, the molten metal may leak through the port until the increased inner pressure is reduced to P'. Such molten metal leakage may cause reduction or variation in the casting amount, which in turn, degrades accuracy. This phenomena may particularly occur if the intake/discharge port 3c has a large cross-sectional area, for example, if the diameter of the port 3c is proximity of 10 mm. Taking the above in view, the third embodiment is provided with a suction means communicated with the confined hermetic space in order to decompress the air in the confined space by an amount corresponding to the expansion amount, i.e., in order to maintain the inner pressure P' within the confined space B of FIG. 3.

Figure 6:
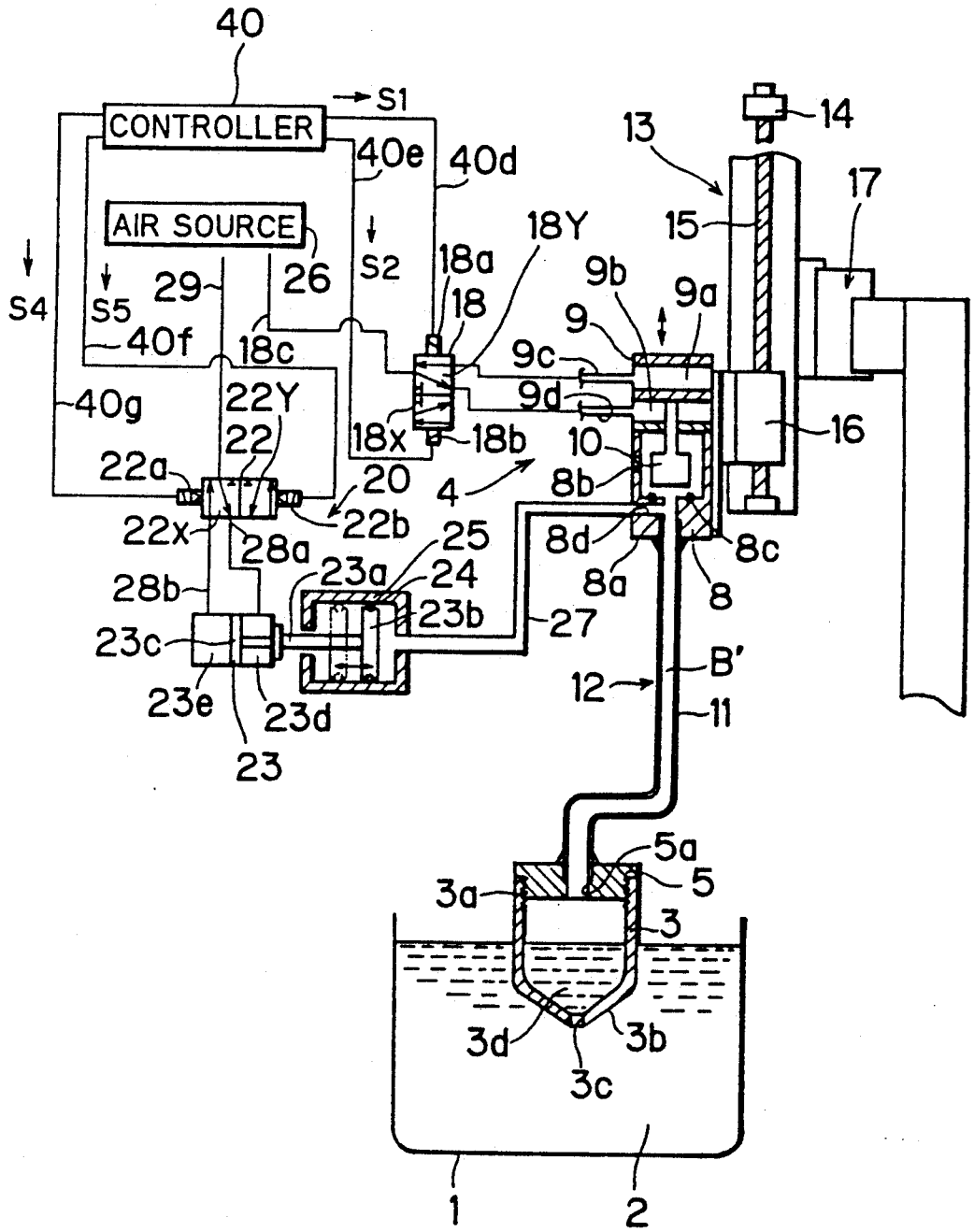
FIG. 6 is a schematic view showing an automatic molten metal supplying device according to a third embodiment of this invention.

In FIG. 6, a confined space B' in the ladle 3 and the tube 11 corresponds to the confined space B shown in FIG. 3, and the confined space B' is connected to the suction means 20. The suction means 20 includes a pneumatic cylinder 23, a cylinder rod 23a, a piston 23b, a cylinder 25, an O-ring 24 and an electromagnetic valve 22. One end of the cylinder 25 is connected to one end of an air line 27, whose another end is connected to a communication hole 8d in communication with the bore 8a of the valve body 8. The piston 23b is slidably disposed within the cylinder 25 through the O-ring 24. The piston 23b is integrally coupled, through the rod 23a, to a piston 23c which is slidably disposed in the pneumaticmatic cylinder 23. The piston 23c divides the pneumatic cylinder 23 into first and second chambers 23d and 23e which are connected to the electromagnetic valve 22 through air passages 28a and 28b, respectively. The electromagnetic valve 22 provides first and second change-over positions 22X and 22Y. For this, first and second solenoids 22a and 22b are connected to a controller 40 of the die-casting machine through lines 40g and 40f, respectively.

With this arrangement, the molten metal is retained in the ladle 3 by shutting off the molten metal accumulation space from the atmosphere by virtue of closing the opening/closing valve 10 similar to the first embodiment. Operation of the suction means 20 is started when the ladle 3 is initially removed from an upper surface of the molten metal 2 in the pot 1 in accordance with the lifting motion of the molten metal supplying unit 12 by the actuation of the vertical moving means 13. However, the operational start timing of the suction means 20 is not limited to this ladle timing, but various timings may be conceivable in conjunction with change in inner pressure due to the temperature increase in the confined space B'.

Decompression signal S4 is transmitted from the controller 40 of the die-casting machine to the first solenoid 22a of the electromagnetic valve 22 through the line 40g in order to positively suck air within the confined space B'. As a result, the electromagnetic valve 22 is changed-over to the first change-over position 22X, so that compressed air in the air source 26 is supplied to the first chamber 23*d* of the cylinder 23 through the air line 28*a*. Consequently, the piston 23*b* is moved leftwardly in FIG. 6 to have a chain line position. Thus, inner volume of the confined space B' is increased, to thereby provide pressure reduction in the space B'. This pressure reducing amount is properly selected in view of pressure increase in the tube 11, etc. due to thermal expansion of the air, which is incurred by the introduction of heated molten metal into the ladle 3. To this effect, the piston 23*c* undergoes a stroke-adjustment. Therefore, in the illustrated embodiment, pressure increase due to the air expansion in the confined space B' can be canceled by the suction of air, to thereby maintain the inner pressure to the P' level or less than P' in the confined space B', to thus avoid dripping of the molten metal through the intake/discharge port 3*c* during ladle transportation.

Molten metal casting into the injection sleeve is achieved in a manner similar to the first embodiment. Here, in order to facilitate the molten metal discharge from the ladle 3, the suction means 20 will provide a casting standby state in which inner pressure of the confined space B' is slightly increased. That is, a stand-by signal S5 is transmitted from the controller 40 to the second solenoid 22*b* of the electromagnetic valve 22 through the line 40*f*, so that the electromagnetic valve 22 is changed-over to the second change-over position 22Y. Accordingly, compressed air in the air source 26 is supplied to the second chamber 23*e* of the cylinder 23 through the air line 28*b* for moving the piston 23*b* rightwardly in FIG. 6. Thus, the piston 23*b* has the solid line position for slightly increasing pressure in the confined space B' for facilitating discharge of the molten metal. Incidentally, the valve opening signal S1 from the controller 40 is generated prior to the generation timing of the stand-by signal S5, and at least, the valve opening signal S1 and the stand-by signal S5 are concurrently generated.

Figure 7:
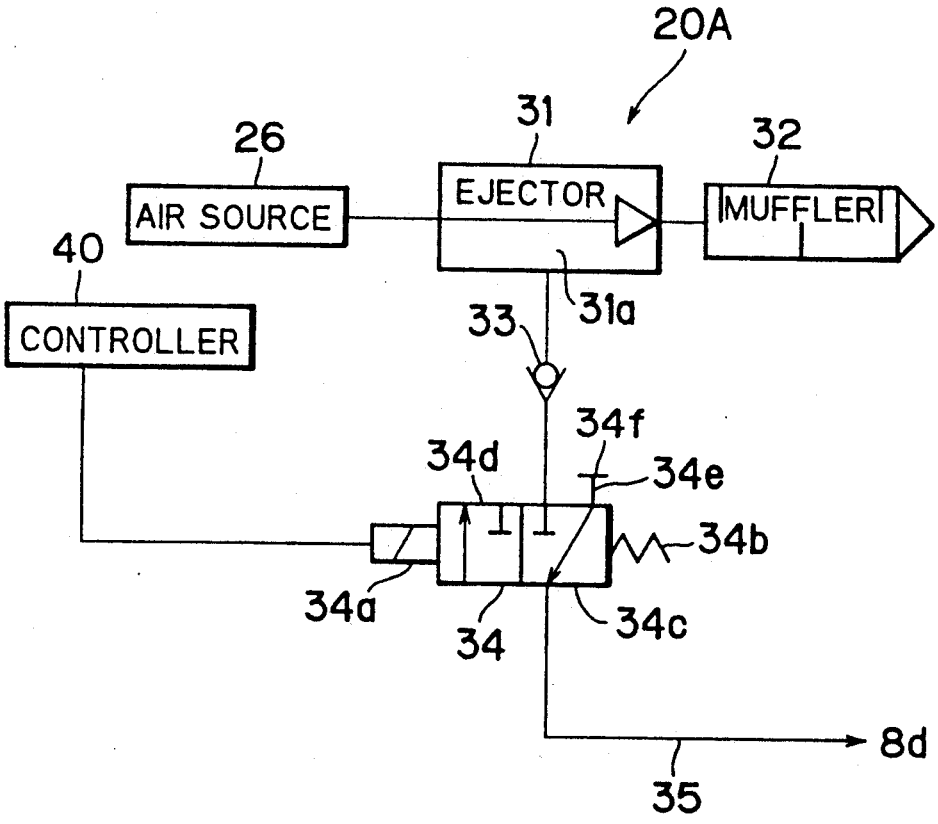
FIG. 7 is a schematic view showing an essential portion of an automatic molten metal supplying device according to a fourth embodiment of this invention.

Next, an automatic molten metal supplying device according to a fourth embodiment of this invention will be described with reference to FIG. 7. Similar to the third embodiment, the forth embodiment is an improvement on the first and the second embodiments in that suction means 20A is provided. However, structure of the suction means 20A is different from that of the third embodiment. The suction means 20A of the fourth embodiment generally includes an electromagnetic valve 34 and an ejector 31. The electromagnetic valve 34 is connected to a communication hole 8*d* (see also FIG. 6) of a valve body 8 through an air passage 35, and is connected to the ejector 31 through a check valve 33. The ejector 31 has an inlet port connected to an air source 26 and an outlet port connected to a muffler 32. Compressed air is continuously supplied to the ejector 31 from the air source 26, and the air is discharged to the atmosphere through the muffler 32. Therefore, low pressure zone 31*a*whose pressure is lower than the atmospheric pressure is provided within the ejector 31. The electromagnetic valve 34 is provided for selectively communicating the low pressure zone 31*a* with the communication hole 8*d*.

The electromagnetic valve 34 is provided with a solenoid 34*a* connected to the controller 40 of the die-casting machine so as to provide first and second change-over positions 34*c* and 34*d* of the valve 34. Further, a spring 34*b* is connected to the electromagnetic valve 34 for normally urging the latter 34 toward the first change-over position 34*c*. Furthermore, a close port 34*e* is provided at the first change over position side of the electromagnetic valve 34, and is plugged by a plug member 34*f*. The controller 40 is provided with a timer (not shown). During the timer ON state, suction signal S6 is continuously applied to the solenoid 34*a* to thereby define the change-over timing and a change-over period with respect to the second change-over position 34*d* of the electromagnetic valve 34. Incidentally, the ON period is previously set by virtue of tests in which a period is obtained for the pressure reduction to P', the pressure being initially increased within the confined space B'.

With this arrangement, the low pressure zone 31*a* is always provided within the ejector 31 because of the continuous compressed air supply from the air source 26. With this state, similar to the first and the third embodiments, the opening/closing valve 10 is closed to shut off the molten metal accumulation space from the atmosphere in order to retain the molten metal in the ladle 3. The vertical moving means 13 is operated for lifting the molten metal supplying portion 12. Immediately after the ladle 3 leaves the surface of the molten metal in the pot 1, the timer is rendered ON. In response to the ON signal, the suction signal S6 is transmitted to the solenoid 34*a* for moving the electromagnetic valve 34 to the second change-over position 34*d* against the biasing force of the spring 34*b*. Therefore, the low pressure zone 31*a* is brought to communication with the confined space B' through the check valve 33, the electromagnetic valve 34 and the air passage 35. Accordingly, the pressure which has been increased within the confined space B' due to the heat of the molten metal can be introduced into the ejector 31. Thus, similar to the third embodiment, the pressure increase within the confined space B', i.e., within the ladle and the tube 11 can be canceled, so that the pressure within the space B' becomes equal to the pressure P' or less than P', to thereby avoid leakage of the molten metal during transportation.

If the timer is rendered OFF, the suction signal S6 is not generated. Thus, the electromagnetic valve 34 is moved to the first change-over position 34*c* because of the biasing force of the spring 34*b*. Accordingly, the confined space B' is disconnected from the ejector 31. In this case, the air within the confined space B' cannot be discharged to the atmosphere because of the plug member 34*f*.

As described above, according to the automatic molten metal supplying device of this invention, since the cross-sectional area of the intake/discharge port of the ladle is properly selected, dripping of the molten metal from the ladle during transportation is avoided and the molten metal in the ladle can be stably and easily retained therein. Since no molten metal drips from the ladle, accuracy in molten metal supplying amount can be improved. Further, since the cross-sectional area of the intake/discharge port is not less than 28 $mm^2$, the molten metal can be smoothly introduced into the ladle, and the molten metal can be smoothly discharged therefrom without any significant reduction in the discharge speed. Accordingly, temperature decrease of the molten metal in the ladle can be kept to a minimum by reducing the shot cycle. Because of the reduction in the shot cycle, generation of the oxide film at the molten metal surface in the ladle can also be avoided, which leads to the enhancement of quality of the molded product. Further, the entire device can have a simple arrangement so as to provide a low cost device.

Further, according to the automatic molten metal supplying device of the third and fourth embodiments, the suction means is selectively connected to the confined space of the ladle and the tube extending between the ladle and the atmosphere communication/blockage means in order to prevent the pressure within the space from being increased. Therefore, pressure increase due to air expansion incurred by the retention of the heated molten metal can be canceled, to thereby further avoid dripping of the molten metal from the ladle during the transportation. Consequently, casting accuracy can further be improved, and clean and safe working condition can be provided.

While the invention has been described in detail and with reference to specific embodiments thereof, it would be apparent to those skilled in the art that various changes and modifications may be made without departing from the spirit and scope of the invention as defined by the appended claims.

What is claimed is:

1. An automatic molten metal supplying device comprising:

a ladle having an upper opening portion, a bottom portion having a molten metal intake/discharge port formed therein, and an inner surface defining a molten metal accumulating space;

a lid portion for closing said upper opening portion of said ladle, said lid portion having a through hole formed therein;

a tubular member having a first end connected to said through hole: and, atmosphere communication/blockage means connected to a second end of said tubular member for selectively disconnecting said molten metal accumulating space from the atmosphere in order to retain the molten metal in said accumulation space, a confined space being provided within said ladle and said tubular member when the molten metal is retained in said accumulating space;

a cross-sectional area of said molten metal intake/discharge port being in a range of from 28 to 80 $mm^2$ so as to be capable of successively supplying the molten metal to a desired location.

2. The automatic molten metal supplying device as claimed in claim 1, further comprising:

suction means selectively communicatable with said confined space for reducing pressure within said confined space when the molten metal is retained in said accumulating space.

3. The automatic molten metal supplying device as claimed in claim 1, wherein said atmosphere communication/blockage means comprises:

a valve body having a communication hole formed therein communicating with atmosphere and a bore formed therein in communication with said first end of said tubular member;

an opening/closing valve movable in said valve body for selectively closing said bore;

a pneumatic cylinder mounted on said valve body;

a piston connected to said opening/closing valve and movable in said pneumatic cylinder, said piston dividing an internal space of said pneumatic cylinder into first and second chambers; and a cylinder driving mechanism for moving said piston to thereby move said opening/closing valve toward and away from said bore.

4. The automatic molten metal supplying device as claimed in claim 3, wherein said cylinder driving mechanism comprises:

an electromagnetic valve connected to said first and the second chambers, the electromagnetic valve having first and second solenoids for selectively providing first and second change-over positions of said electromagnetic valve;

an air source connected to said electromagnetic valve for selectively supplying compressed air into one of said first and the second chambers in response to a change-over operation of said electromagnetic valve; and a controller connected to said first and second solenoids for outputting closing and opening signals to said first and second solenoids, to thereby move said electromagnetic valve to one of said first and second change-over positions, said electromagnetic valve assuming said second change-over position in response to said opening signal so as to communicate said air source with said second chamber, and assuming said first change-over position in response to said closing signal so as to communicate said air source with said first chamber.

5. The automatic molten metal supplying device as claimed in claim 1, wherein said atmosphere communication/blockage means comprises:

a space chamber having a bore formed therein in communication with said first end of said tubular member, said space chamber also having a communication hole formed therein;

an electromagnetic valve connected to said communication hole, said electromagnetic valve having a solenoid and a spring, and providing a first change-over position for shutting off said communication hole from atmosphere and a second change-over position for communicating said communication hole with atmosphere; and an electromagnetic valve driving mechanism for selectively moving said electromagnetic valve to said first change-over position.

6. The automatic molten metal supplying device as claimed in claim 5, wherein said electromagnetic valve driving mechanism comprises a controller which generates a shut-off signal to said solenoid for moving said electromagnetic valve to said first change-over position against a biasing force of said spring.

7. The automatic molten metal supplying device as claimed in claim 4, further comprising:

suction means selectively communicatable with said confined space for reducing pressure within said confined space when the molten metal is retained in said accumulation space.

8. The automatic molten metal supplying device as claimed in claim 7, wherein said valve body further has a second communication hole in communication with said bore formed therein, and wherein said suction means comprises:

a second pneumatic cylinder in communication with said second communication hole;

a second piston slidably movable in said second pneumatic cylinder;

a third cylinder;

a third piston connected to said second piston via a rod, said third piston dividing an internal space of said third cylinder into first and second cylinder chambers; and a second electromagnetic valve connected to said first and second cylinder chambers, said air source being connected to said second electromagnetic valve, and said controller also being connected to said second electromagnetic valve for selectively transmitting a suction signal and a stand-by signal to said second electromagnetic valve, said second electromagnetic valve having a first change-over position for communicating said air source with said first cylinder chamber in response to said suction signal to thereby reduce pressure within the confined space, and said second electromagnetic valve having a second change-over position for communicating said air source with said second cylinder chamber in response to said stand-by signal to thereby increase the pressure within said confined space.

9. The automatic molten metal supplying device as claimed in claim 7, wherein said valve body further has a second communication hole in communication with said bore formed therein, and wherein said suction means comprises:

a second electromagnetic valve connected to said second communication hole, said second electromagnetic valve having a spring and a solenoid connected to said controller, and providing first and second change-over positions; and an ejector connected to said air source and to said second electromagnetic valve through said check valve, a low pressure area being continuously provided within said ejector by way of continuous air supply thereinto from said air source, and said controller providing a suction signal to said solenoid for moving said second electromagnetic valve to said second change-over position against a biasing force of said spring in order to allow fluid communication between said ejector and said second communication hole.

* * * * *